United States Patent [19]

Tarr

[11] Patent Number: 4,556,011

[45] Date of Patent: Dec. 3, 1985

[54] MULTICOLOR TINTER TANK SYSTEM

[75] Inventor: Henry Tarr, Slaterville Springs, N.Y.

[73] Assignee: Auto-Tint, Inc., Ithaca, N.Y.

[21] Appl. No.: 449,592

[22] Filed: Dec. 14, 1982

[51] Int. Cl.[4] ..... B05C 11/10

[52] U.S. Cl. ..... 118/46; 137/266; 222/135; 222/148

[58] Field of Search ..... 137/266; 222/135, 148, 222/132; 118/46

[56] References Cited

U.S. PATENT DOCUMENTS 709,302 9/1902 Case ..... 137/266 X 3,398,858 8/1968 Holloway ..... 222/135 X

*Primary Examiner*—Evan K. Lawrence

*Attorney, Agent, or Firm*—Barnard & Brown

[57] ABSTRACT

A multifluid dispensing system especially suited for web tinting machines or the like. A plurality of fluid and, optionally, air-tight tanks are provided. In a recirculating embodiment, the tanks feed fluid to, and receive fluid from, two manifolds. The upper (output) manifold receiving fluid from each tank slopes to gravity drain into the second manifold. The second (inlet) manifold is level to eliminate low spots for fluid accumulation. The inlet manifold drains into the tanks through valves in the side of, and level with, the manifold. A non-recirculating embodiment uses only the second manifold with pressurized tanks. An optional flush tank may be provided.

18 Claims, 6 Drawing Figures

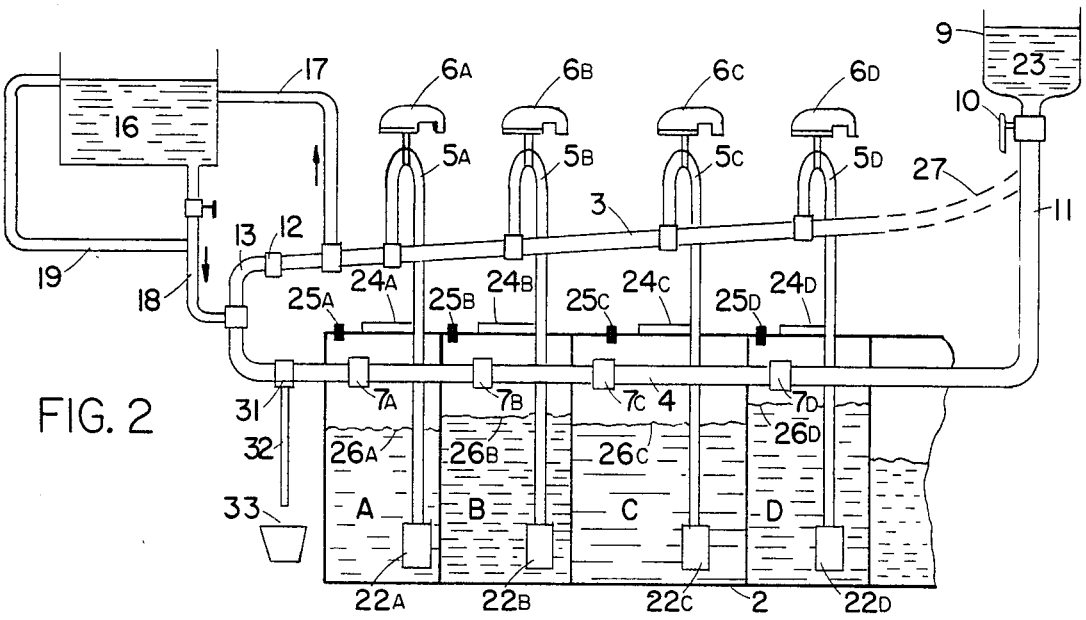
FIG. 2
FIG. 3
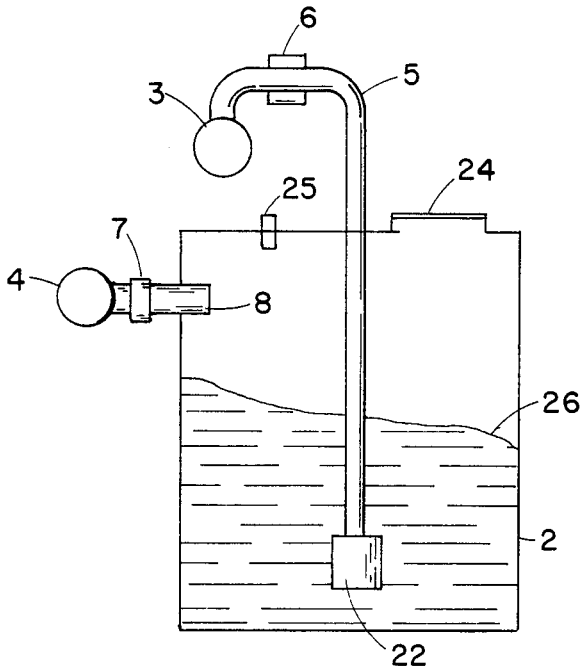

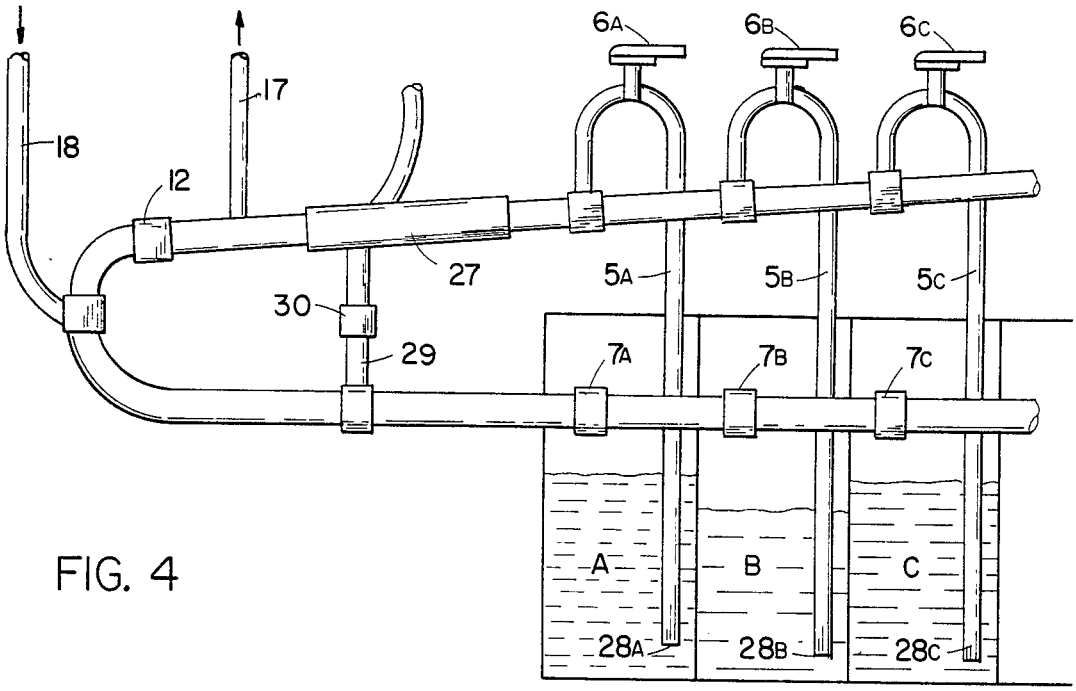
FIG. 4
FIG. 6
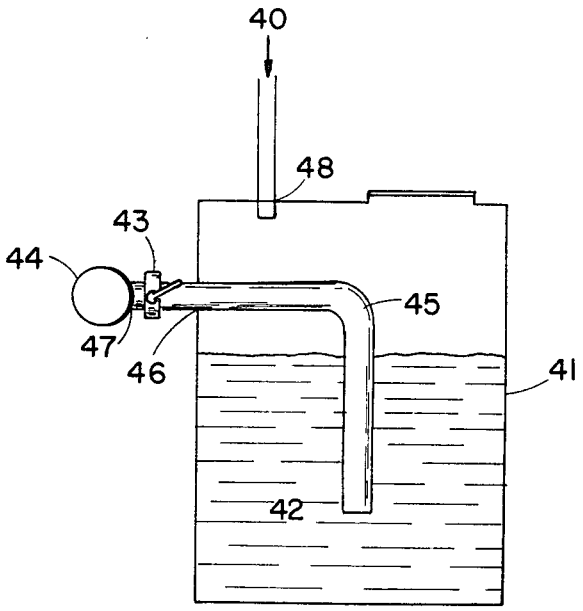

MULTICOLOR TINTER TANK SYSTEM

BACKGROUND OF THE INVENTION

The inventon pertains to the field of systems for containing and dispensing multiple fluids. More specifically, the invention presents a system especially suited for multicolor tinting inks, for use in printing apparatus or the like.

As the cost of paper has increased in recent years, it has become less economical for printers to stock large quantities of different colored paper stock. Instead, many printers have turned to "web tinter" systems. These color the base paper stock before use, allowing the printer to replace a multitude of different colored paper with cheaper white stock, which is then tinted whatever color is required by the job. Typically, the inks or dyes used in such applications are alcohol based and must be kept circulating through the tinter.

Currently, a single tank or pail of ink serves as a source of dye. The dye is pumped into a fountain on the tinter. A drain is provided in the side of the fountain as an overflow, from which excess dye is dumped back into the pail. This method is satisfactory while in use for a single color, although this use of open pails with volatile and flammable dyes does lead to concerns about safety. To change colors, the press operator must drain the fountain, disconnect the pail, flush the lines with clear alcohol, then connect a new pail. Each step is done manually. The fluids must be poured to and from tanks or pails, and lines transferred, all of which leads to problems with spillage and loss of dye. The current method of color changing is obviously messy and unsafe.

It is an object of the invention to provide a system for containing multiple tinter dyes with a minimum of manual handling, spillage and escape of fluid.

It is a further object of the invention to provide a system for dispensing tinter dyes which permits changing colors easily and quickly.

It is a still further object to provide a fluid-handling system for multiple fluids which minimizes the danger from the use of flammable liquids.

Another problem with present methods of changing colors is that of contamination of one dye stock by the last-used stock. The dye left in the lines and in any connecting piping will flow into the next tank of dye, unless special precautions are taken to clean the equipment. This is especially true in recirculating systems, with the added complexity and piping involved.

It is thus an object of the invention to provide a multicolor tank system for tinter inks which allows changing colors with a minimum of contamination of the dyes by other colors.

SUMMARY OF THE INVENTION

The invention presents a dispensing system especially suited to recirculating dye systems.

A plurality of tanks dispense fluid to an output manifold, which is tilted so that it will drain by gravity to one end. Each line from a tank to the manifold has a valve to control output and prevent back flow into the tank. The valves enter the manifold from above, so as to gravity drain into the manifold when the valve closes. A line from the output manifold leads to the tinter fount.

The low end of the output manifold is shut off with a drain valve. The output of the drain valve, and the overflow and a drain line from the tinter fount, is led back to the same tank, containing the color being used, by an inlet manifold. The inlet manifold is level, with outlet valves leading from its sides into the tanks. This level arrangement eliminates low spots and allows all of the fluid in the manifold to drain through whichever output valve is open.

A flushing system may be provided, either by an extra tank, by circulating fluid through the system, or by a reservoir draining through the inlet manifold to a catch basin, which can be dumped. Because of its design, the output manifold will self-drain, and thus need not be flushed.

In a non-recirculating embodiment, the output manifold can be eliminated. Each tank is pressurized by an air supply, and fluids are forced into the inlet manifold by the pressure. Draining and flushing are accomplished as in the recirculating versions, when pressure in the tank is released.

DESCRIPTION OF THE DRAWING

FIG. 2 shows a cut-away view of the preferred embodiment of the invention.

FIG. 3 shows an end cut-away view of one tank.

FIG. 4 shows another embodiment of the invention.

FIG. 6 shows a cut-away view of a single tank in a non-recirculating embodiment of the invention.

DESCRIPTION OF THE PREFERRED EMBODIMENTS

Figure 1:
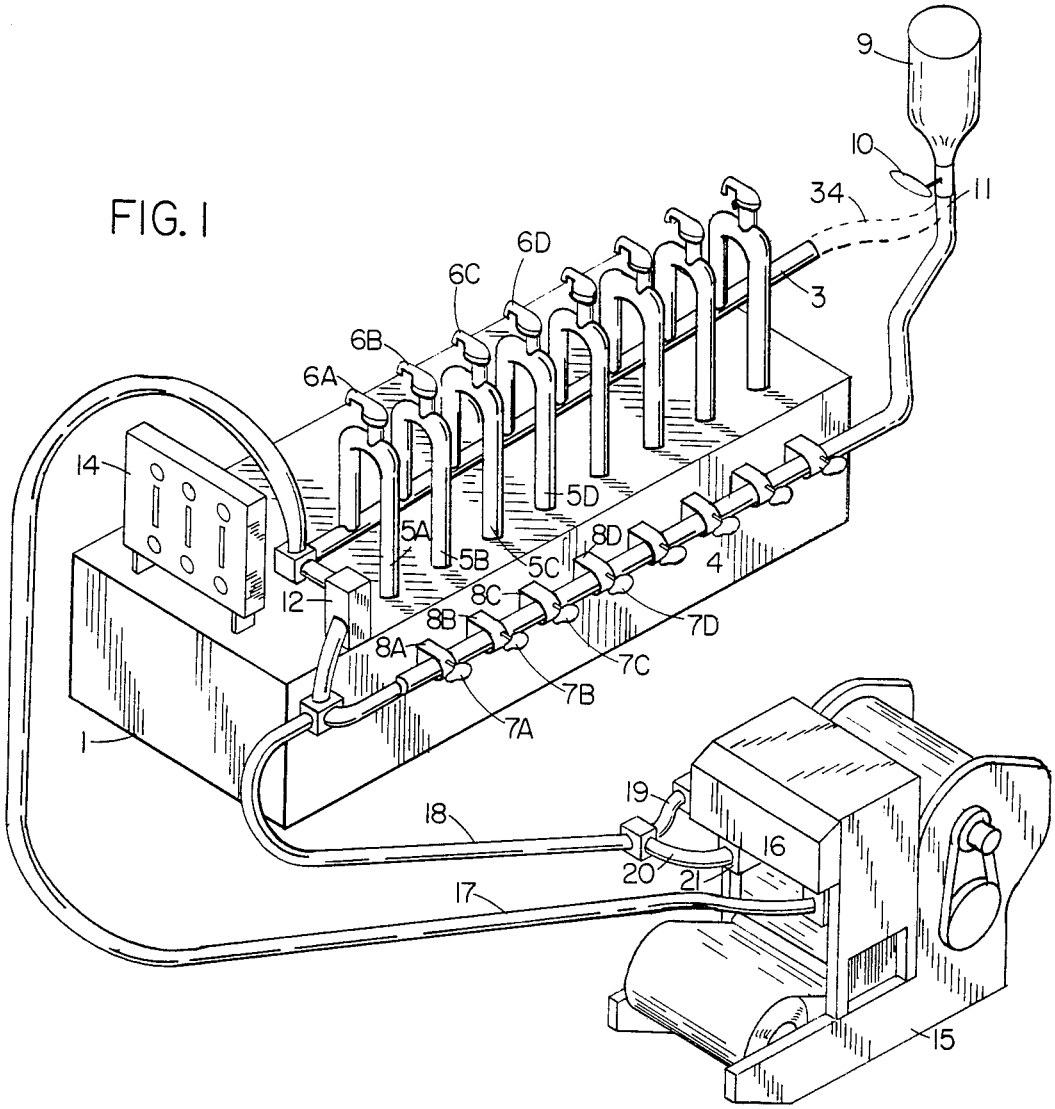
FIG. 1 shows an over-all view of the invention in use.

FIG. 1 shows the invention in use, FIGS. 2 and 3 are cut-away views. In all cases, like numbers indicate like components. For convenience, where multiple identical elements are used, appended letters indicate a feature associated with a given tank: Thus (22A) is a pump in a tank "A", (22B) an identical pump in tank "B", etc.

The invention comprises a large, fluid-tight tank assembly (1) divided up into a number of tanks (A), (B), (C), (D) etc, each of which is fluid-tight and isolated from the others. For safety, given the volatile nature of the dyes used, the tanks are preferably at least covered (24) and may be made air-tight. In such a case a valve (25) must be provided to allow air to enter as the fluid level is pumped down. This valve (25) may be actuated with the controls for the tank, or be a simple one-way ("PCV"- Type) valve, allowing air in, but not out. Each tank is provided with holes or "ports" for introduction ("inlet" or "inputs" ports) or withdrawal ("outlet" or "output" ports) of fluid from the tank.

The heart of the invention, especially in its recirculating embodiments, is the two manifolds, inlet (4) and output (3). Each manifold is provided with holes or "ports" for introduction ("inlet" or "input" ports) or withdrawal ("outlet" or "output" ports) of fluid from the manifold. The output manifold (3) is above the inlet manifold (4) and the tanks and slopes to a drain valve (12) at one end. From the drain valve (12), a tube (13) leads to an input port of the inlet manifold. Thus, if the valve (12) is opened, the output manifold may gravity drain into the inlet manifold. By contrast, the inlet manifold (4), below the output manifold (3) but above the fluid level (26) in the tanks (2), is level from end to end. Valves (7) lead off from outlet ports in the side of the inlet manifold (4) and through level pipes (8) drain into the tanks (2) through the tank inlet ports.

It is vital that the inlet manifold (4) and valves (7) be level (and pipes (8) must be level or slope into the tank), so that there will be no "low spots" in the inlet manifold to collect fluid. Thus, if valve (7A) is open, all of the fluid in the manifold will drain into tank (A), leaving none behind to contaminate the next dye.

Fluid from each tank (2) is pumped into from the tank through an input tube means (5) to an inlet port in the top of the output manifold (3). Each tank may have a submerged pump (22), as shown, or the pump may be located outside the tank. If desired (FIG. 4) a single pump (27) may replace the plurality of smaller pumps, leaving the lower end (28) of the tank feed pipe (5) open, in which case the pump is located at the low end of the output manifold (4) above the drain valve (12). A drain (29) and drain valve (30) may be provided for the pump itself (27), if appropriate. In either case, each input tube means (5) is equipped with an inlet valve (6) located above the inlet port of the output manifold (3). This allows the valve to gravity drain into the manifold, and prevents "low spots" in which fluid may collect.

The valves may be manually operated or remotely controlled via a control panel (14). If remote, it is desirable to use non-electric, preferably air-operated, valves, to minimize the likelihood of sparks near the flammable fluids. Similarly, air-operated pumps are preferred, especially for non-submerged pumps, although electric pumps may be used.

The fluid from an output port of the output manifold (3) is fed to the device requiring the fluid, here shown as a web tinter, mounted on a press (15) (only partially shown), via tube (17). The excess or used fluid returns to an input port of the inlet manifold (4) via return line (18). As shown in FIGS. 1 and 2, the using device may have a reservoir or fount (16) fed through tube (17). When the fluid reaches a pre-determined level it overflows through tube (19) to recirculate back to the tank via the inlet manifold through return line (18). A drain (21) is provided to drain the fount (16) to the return line (18).

In a non-recirculating system (FIG. 6), for example if the device using the fluid uses a float and valve to control fluid level, the invention may be provided with an air-supply system in place of the outlet manifold. A single, level manifold (44) then serves to convey fluid from the tanks, and to drain back into them. A source of compressed air (40) pressurizes the tank (41) containing the fluid (42) to be dispensed, through an air port (48). When the valve (43) located at a side port (47) in the side of the manifold (44) is opened, fluid is forced into a tube (45) extending from under the fluid level in the tank to an outlet port (46) of the tank, and to the valve (43) on the manifold, through a supply port of the manifold and up to the device fount. To drain, the pressure is released, and everything proceeds as for the recirculating system.

Although eight, four and three tanks are shown in FIGS. 1, 2 and 4, respectively, it will be understood that any number of tanks may be included within the teachings of the invention. The actual number used will depend upon the number of colors commonly used in a given shop.

In its simplest form, the invention may be built with only those elements discussed above. It is preferred, however, to provide a means for flushing the last-used dye from the system before introducing the next color. This is done through the use of a flushing solution, most likely clear alcohol (or whatever is used as the dye base). It would be possible to add another tank (i.e. seventh tank to a six-color set-up) and run the system for a period on a supply of clean fluid from that tank, replacing the fluid periodically. This has the disadvantage that the fluid in the extra tank will deteriorate, as it is used over and over, and inadequate flushing will inevitably result in time.

The design of the invention allows a simpler and more effective method to be used. Because the entire system gravity-drains into the inlet manifold, it is only necessary to flush that manifold. A small flush tank (9) of flushing liquid (23) is located above the inlet manifold (4) and connected to it by a tube (11) and valve (10). Once the system is drained, valve (10) is opened for a short period, flushing the manifold (4) into the last-used tank. The addition of a small quantity of clear fluid should have no effect upon the dye in the tank, and might serve to make up for losses from the fount due to evaporation and paper absorption. It this is not desired, a drain valve (31) can be installed in the side of the inlet manifold (4) (level, as in valves (7)) and a tube (32) led from that valve (31) to a catch basin or pail (33), the contents of which may be discarded after flushing, or recycled back to tank (9). If desired the flush tank may be connected with the outlet manifold, as shown at (34), flushing both manifolds.

Figure 5:
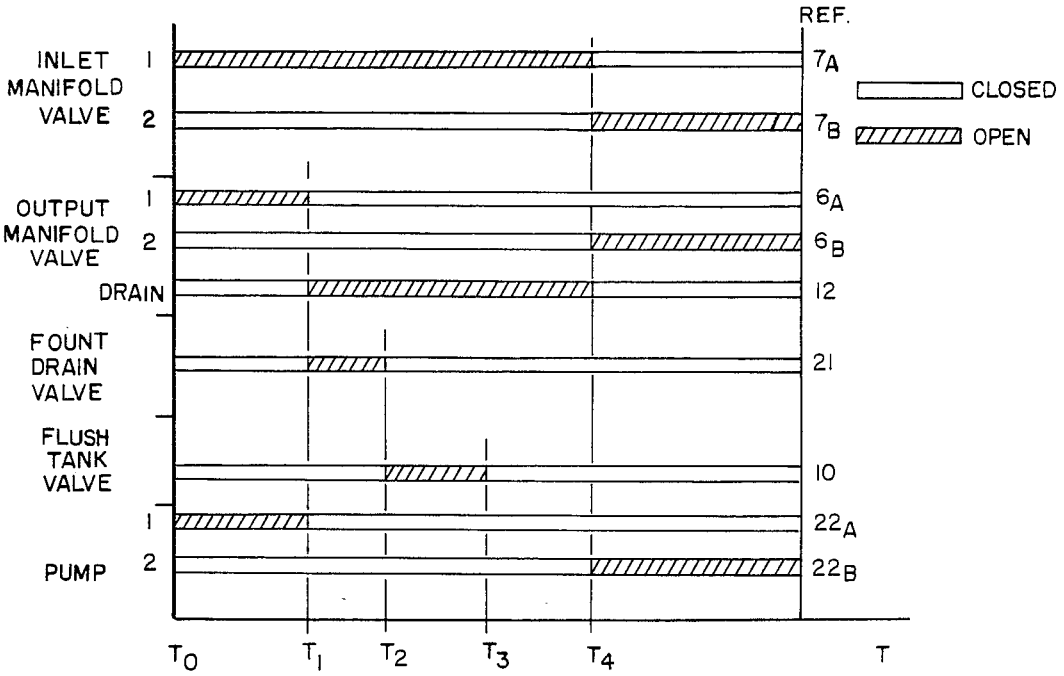
FIG. 5 shows a timing diagram of the system as used.

FIG. 5 shows a timing diagram to clarify the sequence of operations of the invention in use. At the beginning (to), the tinter is running color 1, (i.e. blue) from tank "A". Inlet (7A) and outlet (6A) valves to that tank are open. The operator wishes to switch the system to color 2, (i.e. green) from tank "B". At (t1) he begins the change-over. At (t1) he begins the change-over. Valve (6A) is closed, admitting no further fluid from tank "A", and the pump (22A) is turned off (the valves (6) and pumps (22) may be ganged on a single control, if desired). The output manifold drain (12), and fount drain (21) are opened, and both gravity drain into the inlet manifold. After these have drained (t2), the fount drain is closed. The output manifold drain (12) may be closed, or can remain open, as shown, if the connection shown at (27) in FIG. 2 is used. Fluid is admitted from the flush tank by valve (10) between (t2) and (t3), and flushes into tank "A" through valve (7A). The valve (10) is closed at (t3) and the inlet manifold drains. At (t4), valve (7A) is closed, and valves (7B) and (6B) are opened, and pump (22B) switched on. Fluid is pumped from tank "B" through (6B) to the output manifold into the fount (16). When the fount is full, the overflow returns to "B" through (19), (18) and the inlet manifold (3) and valve (7B), and the tinter is ready to go in the new color.

In addition to the flush tank, the basic invention may be modified to include automatic control and sequencing of the valves. An interlock may be added to ensure that only one valve on each manifold may be operated at once, and preventing simultaneous operation of inlet and output valves on different tanks.

Accordingly, it is to be understood that the embodiments of the invention herein described are merely illustrative of the application of the principles of the invention. Reference herein to details of the illustrated embodiments are not intended to limit the scope of the claims which themselves recite those features regarded as essential to the invention.

I claim:

1. A tank system for multicolor dispensing of tinting fluids to printing equipment or the like, requiring a continuous flow of fluids, comprising:

a. a plurality of tank means for containing fluids, at least one per color to be dispensed, each having inlet ports for entry of fluids into the tank located above the level of the fluid in the tank, and outlet ports for exit of fluid from the tank means;

b. inlet manifold means for conveying fluid to the tank means, for location above the fluid level in the tank means, comprising:

1. a level conduit having top, bottom, and side walls, a plurality of outlet ports in the side walls, a plurality of input port means for admitting fluid into the level conduit;

2. a plurality of valve means, at least one per tank, each having an input and an output, the input sealably connected to an outlet port of the conduit, and the output of at least one valve means per tank connected to an inlet port of one of the tank means and each having open and closed positions for controlling fluid flow from the outlet ports;

3. each of the outlet ports and valves being level with the conduit, such that fluid cannot pool in the ports, valves or conduit;

c. output manifold means for conveying fluid from the tank means, located above the tank means, comprising:

1. a sloping conduit having a top, a bottom, and side walls, upper and lower ends, a plurality of inlet ports in the top and a plurality of output ports;

2. Drain valve means for draining the output manifold, having open and closed positions, an input sealably connected to the lower end of the conduit and an output connected to an input port in the conduit of the inlet manifold means;

3. A plurality of inlet valve means, at least one for each tank means, located at the inlet ports of the conduit, each having an input and an output, the output sealably connected to an inlet port of the conduit;

4. a plurality of input tube means each having two ends, an output end connected to the input of the inlet valve means, and an input end for location below the fluid level in the tank means;

d. a plurality of pump means connected to the output manifold means for causing fluid to flow into the output manifold means from the tank means via the tube means;

e. output means for supplying fluid to the printing equipment having an input connected through a valve to an output port of the output manifold means, and an output adapted to supply fluid to the printing equipment;

f. input means for accepting excess fluid from the printing equipment having an output connected to an input port means of the inlet manifold and an input adapted to receive fluid from the printing equipment.

2. The tank system of claim 1, further comprising means for flushing tinting fluid out of at least the inlet manifold means.

3. The tank system of claim 2 in which the flushing means comprises:

a. flush tank means for holding a flushing fluid located above the inlet manifold means;

b. tube means connecting the flush tank means to an input port means of the inlet manifold means, having valve means for controlling flow of the flushing fluid;

c. said flushing means being arranged such that when the valve means of the tube means are opened, flushing fluid is permitted to flow from the flush tank through the inlet manifold.

4. The tank system of claim 3 in which the tube means of the flushing means connects to an inlet port of the output manifold, and the flushing means thus flushes both inlet and output manifold means.

5. The tank system of claim 3 further comprising: drain valve means having an output and an input, the input being connected to an outlet port of the inlet manifold means; and catch basin means connected to the output of the drain valve means.

6. The tank system of claim 5 further comprising recirculating means for conveying flushing fluid from the catch basin means to the flush tank means.

7. The tank system of claim 1 in which the pump means comprises a plurality of pumps, one for each tank, in the input tube means of the output manifold means.

8. The tank system of claim 7 in which each pump is submerged in the fluid in the tank.

9. The tank system of claim 1 in which the pump means comprises a single pump located in the output manifold between the input and output ports.

10. The tank system of claim 1 in which the pump means is non-electric.

11. The tank system of claim 10 in which the pump means is operated by compressed air.

12. The tank system of claim 1 in which the valve means are remotely controllable.

13. The tank system of claim 12 in which the valve means are non-electric.

14. The tank system of claim 13 in which the valve means are operated by compressed air.

15. The tank system of claim 1 in which the tanks are sealed air-tight, whereby fumes emitted by the fluid in the tank may not escape.

16. The tank system of claim 15 further comprising a positive-ventilation valve on each tank permitting air to enter, but preventing fumes from escaping.

17. The tank system of claim 1 in which the valves of the inlet and output manifolds are arranged such that only one valve in each of the inlet and output manifolds is open at one time.

18. A non-recirculating tank system for multicolor dispensing of fluids to printing equipment or the like, comprising:

a. a plurality of tank means for containing fluids, at least one per color to be dispensed, each having a fluid port for location above the level of the fluid in the tank with tube means for extending therefrom to a point below the level of fluid in the tank, and an air port for introduction of compressed air into the tank means;

b. manifold means for conveying fluid to and from the tank means, for location above the fluid level in the tank means, comprising:

1. a level conduit having top, bottom, and side walls, and a plurality of side ports in the side walls, and supply port means for withdrawing fluid from the conduit;

2. a plurality of valve means, at least one per tank, each having two ports, with control means for controlling flow therebetween, the first port being connected to a side port of the conduit, and the second port of at least one valve means per tank being connected to a fluid port of one of the tank means;

3. each of the first ports and valves being level with the conduit, such that fluid cannot pool in the ports, valves or conduit;

c. air supply means connected to the air ports of the tank means for causing air to flow into the tanks means, causing a pressure therein;

d. output means for supplying fluid to the printing equipment having an input connected through a valve to the supply port of the manifold means, and an output adapted to supply fluid to the printing equipment.

* * * * *